US010822855B2

(12) United States Patent
Kerr et al.

(10) Patent No.: US 10,822,855 B2
(45) Date of Patent: Nov. 3, 2020

(54) POWER BACK DOOR BOUNCE PREVENTION TO ALLOW MAXIMUM OPENING SPEED

(71) Applicant: TOYOTA MOTOR ENGINEERING & MANUFACTURING NORTH AMERICA, INC., Erlanger, KY (US)

(72) Inventors: Norman C. Kerr, Ann Arbor, MI (US); Jay L. Sackett, Ann Arbor, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 79 days.

(21) Appl. No.: 15/852,672

(22) Filed: Dec. 22, 2017

(65) Prior Publication Data

US 2019/0194999 A1 Jun. 27, 2019

(51) Int. Cl.
*E05F 15/622* (2015.01)

(52) U.S. Cl.
CPC ..... *E05F 15/622* (2015.01); *E05Y 2900/546* (2013.01); *E05Y 2900/548* (2013.01)

(58) Field of Classification Search
CPC ..... E05F 15/622; B60J 5/101
See application file for complete search history.

(56) References Cited

U.S. PATENT DOCUMENTS 4,625,455 A 12/1986 Harris et al.
4,688,844 A * 8/1987 Hirose ..... B60J 5/101 296/106
6,035,488 A 3/2000 Kawakatsu
6,516,567 B1 * 2/2003 Stone ..... E05F 15/622 296/55
7,699,378 B2 4/2010 Smith et al.
8,567,012 B2 10/2013 Ng
8,677,563 B2 3/2014 Diep et al.
8,875,442 B2 11/2014 Sohn et al.
9,945,168 B2 * 4/2018 Leonard ..... E05F 15/622
10,094,159 B2 * 10/2018 Grudzinski ..... E05F 15/616
10,227,811 B2 * 3/2019 Osafune ..... F16H 25/20
2006/0042166 A1 * 3/2006 Berklich, Jr. ..... E05F 1/1091 49/341

(Continued)

FOREIGN PATENT DOCUMENTS

JP 11-229705 A 8/1999

*Primary Examiner* — Gregory J Strimbu
(74) *Attorney, Agent, or Firm* — Oblon, McClelland, Maier & Neustadt, L.L.P.

(57) ABSTRACT

A power back door for a vehicle, in which the back door is automatically opened and closed by left and right power back door drive devices, each of the power back door drive devices including an inner tube encompassed by an outer tube; a motor; a spindle screw that is turned by the motor; a spindle nut attached to one end of the inner tube and travels up and down the spindle screw to cause the inner tube to extend and contract relative to the outer tube over a length of travel; and a stopper fixed to the end of the spindle screw to stop the movement of the spindle nut. A length of travel of the left power back door drive device is different than a length of travel of the right power back door drive device so as to attenuate bouncing of the back door when the back door reaches a fully opened position.

14 Claims, 2 Drawing Sheets

(56) References Cited

U.S. PATENT DOCUMENTS

| | | | | |
|---|---|---|---|---|
| 2010/0162839 | A1* | 7/2010 | Reif | F16D 7/021 74/89.38 |
| 2015/0256048 | A1* | 9/2015 | Ohta | E05F 3/02 310/80 |
| 2017/0114582 | A1 | 4/2017 | Ishikawa | |
| 2017/0191553 | A1* | 7/2017 | Heiberger | F16H 25/20 |
| 2018/0216391 | A1* | 8/2018 | Takizawa | B60J 5/10 |

* cited by examiner

POWER BACK DOOR BOUNCE PREVENTION TO ALLOW MAXIMUM OPENING SPEED

FIELD OF DISCLOSURE

The present disclosure relates generally to a power back door of a vehicle that can be automatically driven by a pair of power back door drive devices, and is applicable to a hatchback-type back door or power lift gate.

BACKGROUND

Back doors or lift gates in the rear of motor vehicles are frequently opened and closed to place or remove items in the rear of the vehicle. The speed at which the back door or lift gate is opened requires that it must slow down near the full open position so that it does not bounce when it reaches the end of travel. The back door or lift gate may be slowed down as it approaches the end by reducing the speed of a power back door drive mechanism. However, reducing the speed causes the door to be slow to open. The slow opening speed leads to a sense of low quality, as well as being an inconvenience for the user. It would be preferable to remove the need to slow down the door near full open position and decrease the opening time, without the door bouncing as it reaches the end of travel.

The foregoing "Background" description is for the purpose of generally presenting the context of the disclosure. Work of the inventors, to the extent it is described in this background section, as well as aspects of the description which may not otherwise qualify as prior art at the time of filing, are neither expressly or impliedly admitted as prior art against the present invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
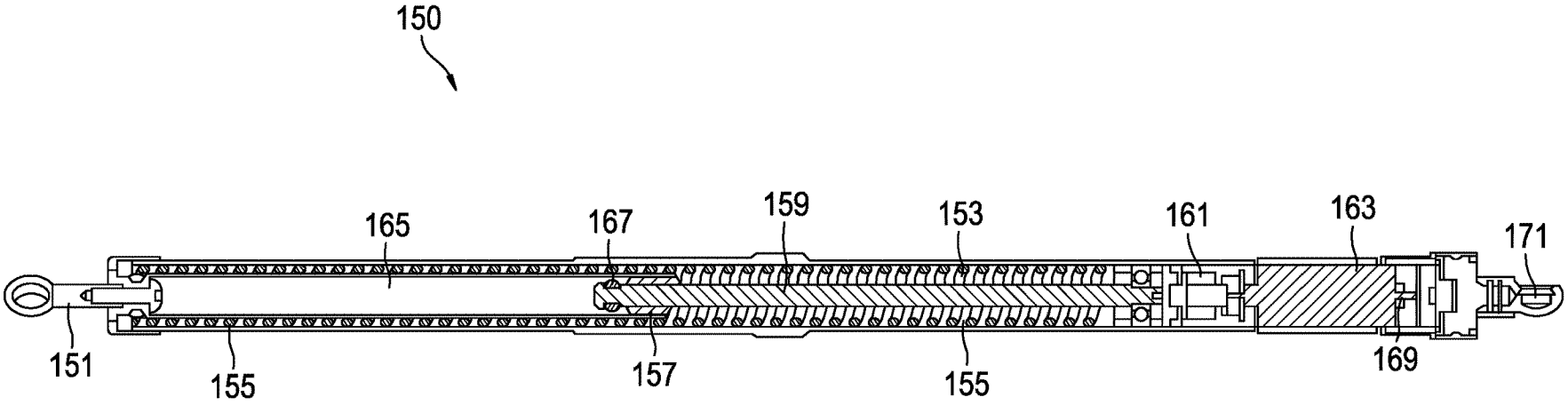
FIG. 1 is a cross section of one of a pair of a power back door drive devices in full open position.

Referring now to the drawings, wherein like reference numerals designate identical or corresponding parts throughout several views, the following description relates to power back door drive devices for automatically opening and closing a power back door of a vehicle, including hatchback-type back doors or power lift gates.

FIG. 1 illustrates a cross section of a power back door drive device 150. The power back door drive device is driven by a motor 163 to provide automatic opening and closing of a back door, such as a hatchback-type door. The dimensions and strength of the power back door drive device are based on the size and weight of the back door. One end of the power back door drive device is attached to the body of the vehicle while the other end is attached to the back door. The position of the power back door drive device is set to ensure that sufficient lifting force is applied to open the back door.

The power back door drive device 150 includes a joint 151 for attaching to the vehicle body. The joint 151 is connected to an end of an inner tube 165. The inner tube 165 is surrounded by an outer tube 155 and may slide in and out of the outer tube. A spring 153 is also arranged inside the outer tube 155. The power back door drive device 150 may include a spindle nut 157 that screws over threads of a spindle screw 159. A planetary gear 161 may be integrated between the spindle screw 159 and the motor 163 to change the rotation speed of the motor to a slower speed for driving the spindle screw 159. The motor 163 turns the planetary gear 161, which turns the spindle screw 159 at a slower rotation speed than the speed of the motor. Turning the spindle screw 159 runs the spindle nut back and forth along the inner tube axis. The inner tube 165 extends and retracts, while the outer tube 155 is a cover for the spring 153 to keep out dust and water. A circuit element 169 is associated with the motor 163. A separate engine control unit (ECU) controls the motor in conjunction with the circuit element 169. Another joint 171 connects the other end of the power back door drive device 150 to the back door. Joint 151 is similar to the joint 171.

An end of the spindle screw 159 includes a stopper 167. The spindle nut 157 is attached to one end of the inner tube 165. The stopper 167 is a fixed device on the end of the spindle screw 159 that acts to stop the spindle nut 157 to jam against and stop the spindle screw 159 at the end of the travel of the spindle nut 157.

Operation of the power back door is by rotation of the motor 163 as controlled by the ECU and rotation of the planetary gear 161. The spindle screw 159 is rotated, and the power drive device is expanded along the tube axial direction by movement of the spindle nut 157 as it screws onto the spindle screw 159. Contraction of the unit is performed by reverse rotation of the spindle screw 159, rotation of the planetary gear 161, and rotation of the back door motor 163. The spindle nut 157 is stopped by the stopper 167 when the inner tube 165 is fully extended and the spindle screw 159 reaches the end of travel.

An aspect of the present disclosure includes a pair of power back door drive devices 150, in which the length of travel of one of the power back door drive devices is shorter than the other. Regarding FIG. 1, the length of travel L of a power back door device is the total length along the spindle screw 159 that the spindle nut 157 screws back and forth. An aspect of changing the length of travel is to design one of the power back door drive devices to have an extended length that is shorter than the other by about 1 to 5 mm. A power back door drive device is fully extended when the spindle nut 157 has reached the stopper 167 and the inner tube 165 is extended from the end of the outer tube 155. Another aspect of changing the length of travel is to design a spindle screw of one power back door drive device to be shorter than the spindle screw of the other power back door drive device by about 1 to 5 mm. An alternative aspect of changing the length of travel is to move the position of the stopper 167 in one of the power back door drive devices toward the joint 171 by about 1 to 5 mm. The difference in length of travel between the two power back door drive devices causes the input into the door, at the end of their travel, to be uneven so that instead of resonating the door with a single large pulse, causing the door to bounce, the door receives uneven pulses and the mass of the door acts as a damper. Subsequently, the door absorbs the inputs from the power back door drive devices without bouncing.

Figure 2:
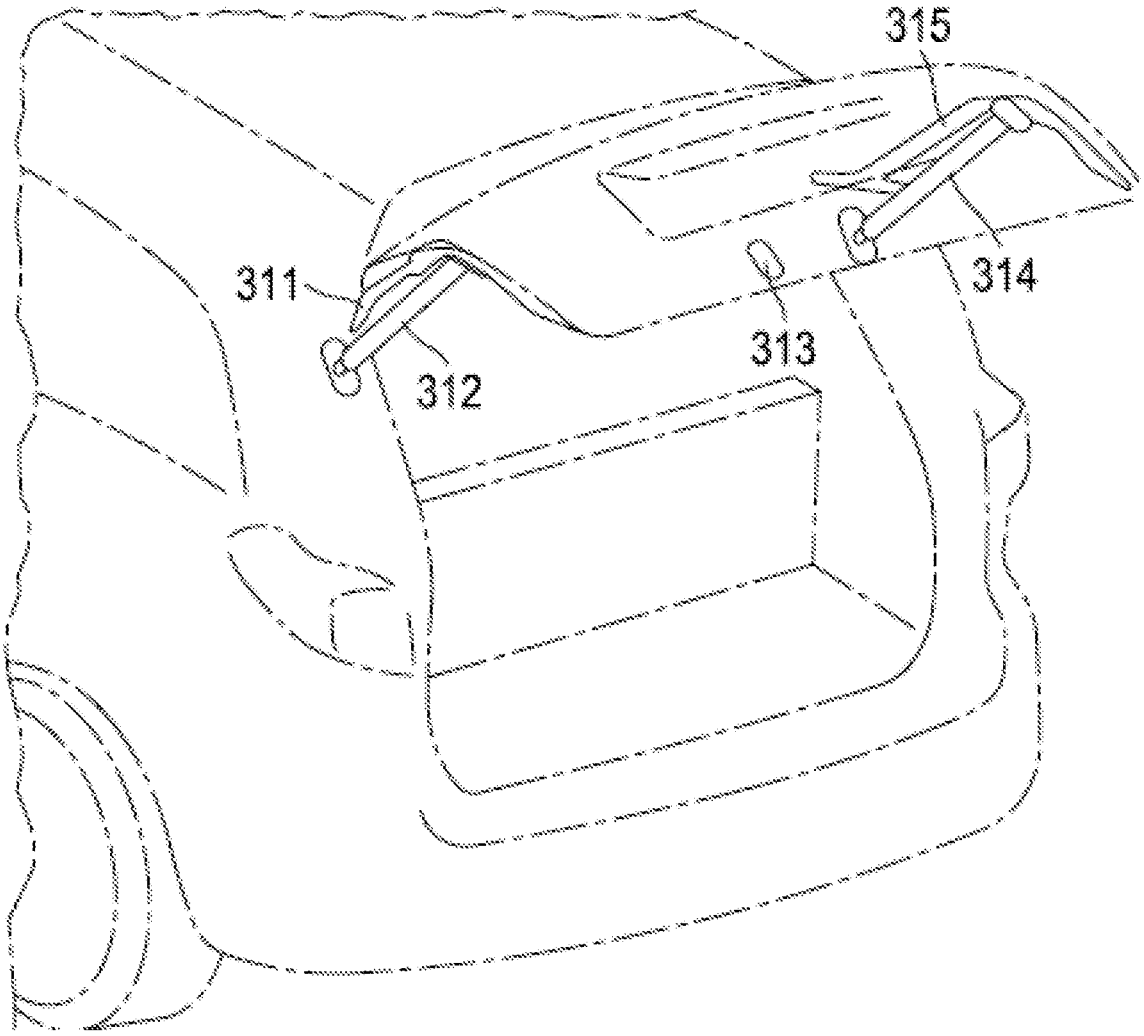
FIG. 2 is a perspective view of a hatchback-type vehicle in which a pair of power back door drive devices are mounted to a hatchback-type back door.

FIG. 2 is a perspective view of a hatchback-type vehicle having a back door that is opened and closed by a pair of power back door drive devices, including a left drive device 312 and a right drive device 314. The back door may also be equipped with respective touch sensors 311 and 315 in order to protect a user from getting hands or fingers caught in the door as it closes. A lock mechanism 313, which is controlled by the ECU, is for locking the door in the closed position.

Provided the pair of power back door drive devices 312, 314, in which the travel length of one of the drive device is shorter than the travel length of the other of the drive devices, the opening time of the back door is reduced without any additional complex mechanisms and the back door does not bounce. As such, a user experiences a more solid operation of the door without noticing a difference in operation between the two power back door drive devices. The user may sense that the back door has an improved quality due to the solid operation.

Numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A power back door for a vehicle, in which the back door is automatically opened and closed by a single left power back door drive device provided on a first side of the back door and a single right power back door drive device provided on a second and opposite side of the back door, each of the power back door drive devices comprising:

an inner tube encompassed by an outer tube;

a motor;

a spindle screw that is turned by the motor, the spindle screw having a first end and a second end;

a spindle nut attached to one end of the inner tube and travels up and down the spindle screw to cause the inner tube to extend and contract relative to the outer tube;

and a stopper fixed to the first end of the spindle screw to stop the movement of the spindle nut at an end of a length of travel of the spindle nut, wherein the length of travel of the spindle nut of the left power back door drive device is different than the length of travel of the spindle nut of the right power back door drive device so as to attenuate bouncing of the back door when the back door reaches a fully opened position.

2. The power back door of claim 1, wherein:

an end of the stopper of the left power back door drive device is located at a position in the spindle screw of the left power back door drive device that is a first distance from the motor of the left power back door drive device, an end of the stopper of the right power back door drive device is located at a position in the spindle screw of the right power back door drive device that is a second distance from the motor of the right power back door drive device, and the first distance and the second distance are unequal.

3. The power back door of claim 1, wherein the second end of each of the spindle screws is opposite to the first end of each of the spindle screws, wherein a length from the first end to the second end of the spindle screw of the left power back door drive device is about 1 mm to about 5 mm different than a length from the first end to the second end of the spindle screw of the right power back door drive device.

4. The power back door of claim 1, wherein a position of an end of the stopper relative to the first end of the spindle screw of the left power back door drive device is different than a position of an end of the stopper relative to the first end of the spindle screw of the right power back door drive device.

5. The power back door of claim 1, wherein a length of the inner tube of the left power back door drive device is different than a length of the inner tube of the right power back door drive device.

6. The power back door of claim 5, wherein the difference in the lengths of the inner tube of the left and right power back door chive devices is about 1 to about 5 mm.

7. The power back door of claim 1, wherein the left and right power back door drive devices each further comprising a planetary gear positioned between the motor and the spindle screw to slow rotation of the spindle screw relative to the rotation of the motor.

8. The power back door of claim 1, wherein the back door is a hatchback door.

9. The power back door of claim 1, wherein the back door is a power lift gate.

10. A method of operating a power back door, the power back door including a single left power back door drive device provided on a first side of the back door and a single right power back door drive device provided on a second and opposite side of the back door, each of the power back door drive devices includes a motor, an inner tube encompassed by an outer tube, a spindle nut fixed to an end of the inner tube and a stopper fixed to a first end of a spindle screw which is opposite to a second end of the spindle screw, and the spindle nuts screw onto a respective one of the spindle screws, the method of operating each of the power back door drive devices respectively comprising:

rotating the motor;

rotating the spindle screw using the motor;

expanding the power back door drive device by screwing the spindle nut along the spindle screw to cause movement of the inner tube relative to the outer tube and in a direction away from the motor;

stopping screwing of the spindle nut when the spindle nut reaches the stopper constituting an end of a length of travel of the spindle nut, wherein the length of travel of the spindle nut of the left power back door drive device is different than the length of travel of the spindle nut of the right power back door drive device so as to attenuate bouncing of the back door when the back door reaches a fully opened position.

11. The method of claim 10, wherein the spindle nut of the left power back door drive device reaches the stopper of the left power back door device before the spindle nut of the right power back door drive device reaches the stopper of the right power back door device.

12. The method of claim 10, wherein the difference in the length of travel between the left and right power back door drive devices is about 1 mm to about 5 mm.

13. The method of claim 12, wherein the difference in length of travel between the left and right power back door drive devices is about 5 mm.

14. The method of claim 10, wherein the left and right power back door drive devices each includes a planetary gear, the planetary gears slow a rotation of the spindle screws relative to a rotation speed of the motors, respectively.

* * * * *